US006413071B1

(12) United States Patent
Helms, Jr. et al.

(10) Patent No.: US 6,413,071 B1
(45) Date of Patent: Jul. 2, 2002

(54) THIN PLATE SPINNERETTE ASSEMBLY

(75) Inventors: Charles F. Helms, Jr., Greenwood, SC (US); Harold R. Vickery, Candler; Keith V. Blankenship, Asheville, both of NC (US)

(73) Assignee: BASF Corporation, Mt. Olive, NJ (US)

( * ) Notice: Subject to any disclaimer, the term of this patent is extended or adjusted under 35 U.S.C. 154(b) by 0 days.

(21) Appl. No.: 09/536,293

(22) Filed: Mar. 27, 2000

(51) Int. Cl.[7] ..... D01D 4/08

(52) U.S. Cl. ..... 425/192 S; 425/382.2; 425/463

(58) Field of Search ..... 425/192 S, 382.2, 425/378.2, 463, 131.5, 464

(56) References Cited

U.S. PATENT DOCUMENTS

| | | | | | |
|---|---|---|---|---|---|
| 2,096,362 | A | | 10/1937 | Lehman | 264/174.11 |
| 2,988,420 | A | | 6/1961 | Ryan, Jr. et al. | 264/168 |
| 3,081,490 | A | * | 3/1963 | Heynen et al. | 425/463 |
| 3,458,616 | A | | 7/1969 | Guess, Jr. et al. | 425/131.5 |
| 3,540,077 | A | | 11/1970 | Nakagawa et al. | 425/131.5 |
| 3,553,774 | A | | 1/1971 | Ruck et al. | 264/172.17 |
| 3,924,045 | A | | 12/1975 | Ogasawara et al. | 264/172.18 |
| 4,406,850 | A | | 9/1983 | Hills | 425/131.5 |
| 4,564,350 | A | * | 1/1986 | Holmes et al. | 425/192 S |
| 4,717,325 | A | | 1/1988 | Fajimura et al. | 425/131.5 |
| 4,738,607 | A | | 4/1988 | Nakajima et al. | 425/131.5 |
| 4,846,653 | A | | 7/1989 | Beck et al. | 425/131.5 |
| 5,162,074 | A | | 11/1992 | Hills | 425/131.5 |
| 5,344,297 | A | | 9/1994 | Hills | 425/131.5 |
| 5,352,106 | A | | 10/1994 | Lenk et al. | 425/192 S |
| 5,393,219 | A | | 2/1995 | Hagen et al. | 425/382.2 |
| 5,511,960 | A | | 4/1996 | Terakawa et al. | 425/382.2 |
| 5,562,930 | A | | 10/1996 | Hills | 425/198 |
| 5,635,222 | A | * | 6/1997 | Meidhof | 425/382.2 |
| 5,662,947 | A | | 9/1997 | Kretzschmar et al. | 425/192 S |

* cited by examiner

*Primary Examiner*—Nam Nguyen
*Assistant Examiner*—Thu Khanh T. Nguyen
(74) *Attorney, Agent, or Firm*—Nixon & Vanderhye P.C.

(57) ABSTRACT

Spinnerette assemblies for forming synthetic fibers whereby a relatively thin orifice plate is compressively sealed against a planar face of a mounting block. The spinnerette assemblies preferably include a mounting block having a planar mounting face and a least one supply bore having a discharge opening at the mounting face. A planar orifice plate is positioned in contact with the mounting face of the mounting block and includes a capillary opening in fluid communication with the discharge opening of the supply bore. A series of attachments (preferably screws) circumferentially surround the capillary opening of the orifice plate so as to compressively rigidly fix the orifice plate to the mounting face of the mounting block and thereby seal the capillary opening against fluid leakage. Most preferably, the attachments (e.g., screws) are substantially equally circumferentially spaced apart from one another in surrounding relationship to the capillary opening so as to impart a symmetrical circumferential compressive sealing force therearound.

13 Claims, 1 Drawing Sheet

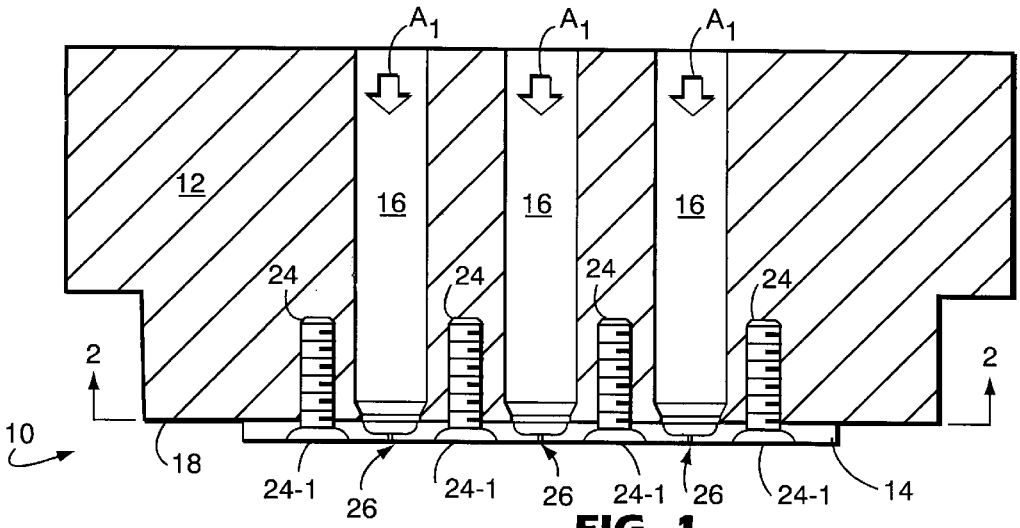
FIG. 1
FIG. 2
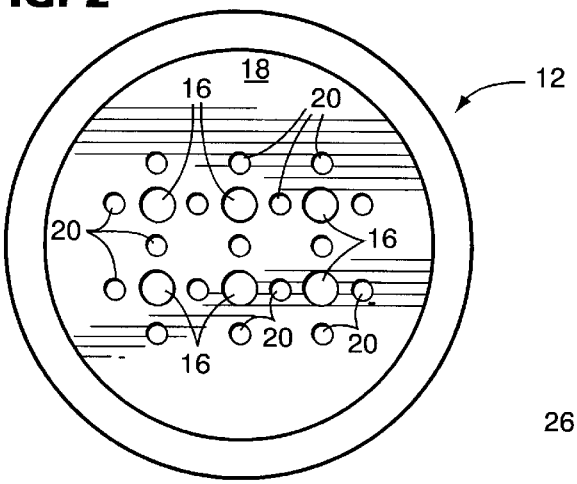
FIG. 3
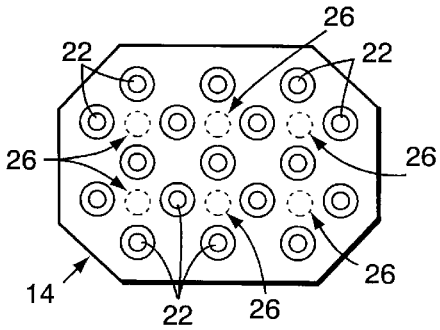
FIG. 4
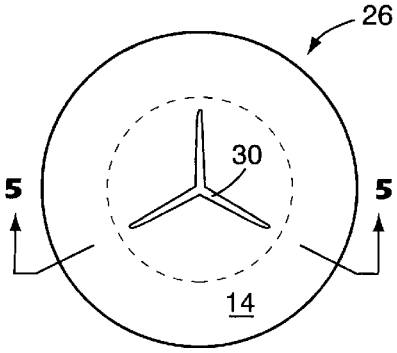
FIG. 5
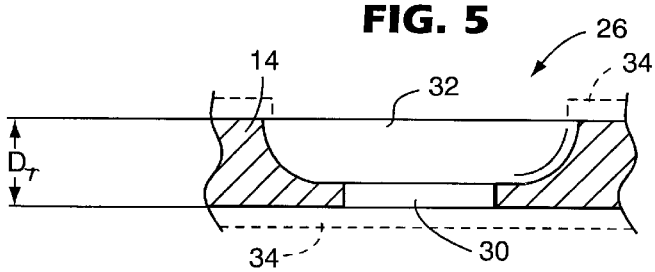

THIN PLATE SPINNERETTE ASSEMBLY

FIELD OF THE INVENTION

The present invention relates generally to synthetic fiber spinning apparatus. More specifically, the present invention relates to spinnerette assemblies employed to spin synthetic fibers.

BACKGROUND AND SUMMARY OF THE INVENTION

The spinning of synthetic fibers is notoriously well known. In this regard, a melt or solution of fiber-forming polymeric material is extruded through extremely fine orifices formed in a spinnerette capillary die. The individual orifices may be virtually any geometric shape to form the desired cross-sectional fiber configuration to meet specific end-use applications.

In order to develop new or improved functional synthetic fiber cross-sections that can give desirable or enhanced fibers properties (such as superior soil hiding, comfort, stiffness, wear resistance, optical appearance, modification ratio and the like), spinneret capillary dies must be designed using a combination of mathematical modeling, engineering, practical experience and artistic ability. The final result in the design process is the need to fabricate many various capillary dies that are subjected to experimentation to determine the optimum fiber cross-section profile design.

There exists, however, real non-trivial problems associated with the design, testing and development of conventional spinnerette capillary dies. For example, the relatively large block capillary dies take a substantial time to produce and can be quite expensive as a result. As a result, there is little, if any, room for true trial and error development.

It would therefore be quite advantageous if spinnerette die capillaries could be provided which are relatively easily and economically fabricated to allow for a variety of spinnerette orifice design configurations to be tested during development. It is towards fulfilling such a need that the present invention is directed.

Broadly, the present invention is embodied in spinnerette assemblies for forming synthetic fibers whereby a relatively thin orifice plate is compressively sealed against a planar face of a mounting block. More specifically, the spinnerette assemblies of the present invention include a mounting block having a planar mounting face and a least one supply bore having a discharge opening at the mounting face. A planar orifice plate is positioned in contact with the mounting face of the mounting block and includes a capillary opening in fluid communication with the discharge opening of the supply bore. A series of attachments (preferably screws) circumferentially surround the capillary opening of the orifice plate so as to compressively rigidly fix the orifice plate to the mounting face of the mounting block and thereby seal the capillary opening against fluid leakage. Most preferably, the attachments (e.g., screws) are substantially equally circumferentially spaced apart from one another in surrounding relationship to the capillary opening so as to impart a symmetrical circumferential compressive sealing force therearound.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein;

FIG. 1 is a cross-sectional elevational view of a spinnerette die assembly according to the present invention;

FIG. 2 is a bottom plan view of the mounting block employed in the spinnerette die assembly shown in FIG. 1 as taken along line 2—2 therein;

FIG. 3 is a bottom plan view of an exemplary thin plate spinnerette with fiber-forming orifices that may be mounted to the mounting block shown in FIG. 2;

FIG. 4 is a greatly enlarged bottom plan view of one possible fiber-forming orifice configuration that may be formed in the thin plate spinnerette shown in FIG. 3; and FIG. 5 is a cross-sectional elevational view of the fiber-forming orifice depicted in FIG. 4 as taken along line 5—5 therein.

DETAILED DESCRIPTION OF THE INVENTION

Accompanying FIG. 1 shows one presently preferred embodiment of a spinnerette assembly 10 according to the present invention. In this regard, the spinnerette assembly 10 includes an upstream mounting block 12 and a downstream thin plate spinnerette 14 rigidly connected thereto in a manner to be described in greater detail below.

The mounting block 12 has a series of longitudinally (relative to the fiber-spinning direction noted by the arrows Al) extending supply bores 16. The discharge ends of the supply bores 16 open onto a planar mounting surface 18 as is perhaps more clearly shown in FIG. 2. As depicted therein, the mounting block 12 includes two rows of three supply bores 16. However, other arrangements and numbers of supply bores 16 may be envisioned without departing from the scope of the present invention. Each of the supply bores 16 is surrounded by a closely adjacent series of threaded bores (a representative few of which are identified by reference numeral 20 in FIG. 2). The threaded bores 20 are spaced apart from one another about the circumference of the supply bores 16. Most preferably, the threaded bores 20 are equally spaced apart from one another about the circumference of an adjacently positioned supply bore 16. For example, as shown in FIG. 2, each of the supply bores 16 has four threaded bores 20 which are spaced apart from one another by substantially 90°. Of course, more or less numbers of threaded bores may be provided as compared to that shown.

The thin spinnerette plate 14 is shown in greater detail in accompanying FIG. 3. In this regard, the spinnerette plate 14 includes a series of countersunk apertures (an exemplary few of which are identified by reference numeral 22 in FIG. 3) each of which is in registry with a respective one of the threaded bores 20 of the mounting block 12. The countersunk apertures 22 receive respective threaded screws 24 so as to compressively hold the spinnerette plate 14 in fluid-tight contact with the planar face 18 of the mounting block 12. As a result, the screws 24 impart a symmetrical circumferential compressive sealing force surrounding each of the orifices 26 so as to seal their respective capillary opening 30 (see FIGS. 4 and 5) against fluid leakage. The apertures 22 are countersunk to an extent that the heads 24-1 of the screws 24 are flush with the external planar surface of the spinnerette plate 14 thereby allowing the plate 14 to be easily cleaned.

The supply bores 16 accept a flow of fiber-forming polymeric material (e.g., a melt of thermoplastic polymeric material) and delivers it to individual ones of the orifices 26 formed in the thin plate spinnerette 14. In this regard, it will be understood that the orifices 26 are too small sized to be clearly visibly shown in FIGS. 1 and 3. Thus, the regions on the plate 14 where the orifices 26 are located have only generally been identified in FIGS. 1 and 3. Greatly enlarged representations of an exemplary one of the orifices 26 is shown, however, in accompanying FIGS. 4 and 5.

The enlarged views of FIGS. 4 and 5, however, depict an exemplary orifice 26 that may be embodied in the plate 14 of the present invention. Specifically, the orifice 26 includes a fiber-forming capillary opening 30 through which fiber-forming polymeric material is extruded. The capillary opening 30 communicates with an upstream recessed basin 32 which serves to feed the capillary opening 30 with the polymeric material.

It will be observed that the capillary opening 30 depicted in FIG. 4 just happens to be in the form to produce symmetric trilobal fibers. The art is, of course, replete with various geometric configurations of capillary openings each of which may be usefully employed to form synthetic fibers of a desired symmetric or asymmetric cross-section. Thus, virtually any conventional geometric configuration of capillary opening may be employed in the practice of this invention and the trilobal configuration of the capillary opening 30 depicted in FIG. 4 represents one possible exemplary embodiment thereof. As such, circular, rectangular, triangular, oval fiber cross-sections may be made by correspondingly configured capillary openings, as well as symmetrical or asymmetrical multilobal capillary openings.

The capillary opening 30 may be formed by any conventional precision machining technique, such as, for example, etching, wire EDM, laser micro-machining and the like. For example, the upstream basin 32 may be formed by etching the plate 14 to a desired depth, followed by forming the capillary opening itself via laser micro-machining to precise tolerances. When conducting etching, the plate 14 may include suitable photoresist layers 34 thereon which are patterned to allow only the basins 32 to be formed via a subsequent etching process. Once the desired etching has been accomplished, the photoresist layers 34 may be removed.

Most preferably, the plate 14 has a thickness dimension $D_t$ that is less than about 0.25 inch. Typically, however, the thickness dimension $D_t$ of the plate 14 will be in the range between about 0.01 inch to about 0.25 inch, and usually between about 0.03 inch to about 0.09 inch. Thicknesses of about 0.05 inch have been advantageously employed to form orifice plates 14 in accordance with the present invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A spinnerette assembly for forming synthetic fibers comprising:

a mounting block having a planar mounting face and plural supply bores each having a respective discharge opening at said mounting face; and a planar orifice plate having a thickness of less than about 0.25 inch in contact with said mounting face of said mounting block, said orifice plate having a plurality of capillary openings each in fluid communication with the discharge opening of a respective one of said supply bores; and a series of attachments uniformly circumferentially surrounding each of said capillary openings of said orifice plate and said discharge opening of each said respective one of said supply bores so as to impart a symmetrical circumferential compressive sealing force surrounding each of said capillary openings and said discharge opening of said respective one of said supply bores and thereby compressively rigidly fix said orifice plate directly to said mounting face of said mounting block to thereby seal each of said capillary openings against fluid leakage.

2. The spinnerette assembly of claim 1, wherein said series of attachments include a number of screws threadably coupling said orifice plate to said mounting block.

3. The spinnerette assembly of claim 2, wherein said screws are circumferentially spaced-apart in surrounding relationship to said capillary opening.

4. The spinnerette assembly of claim 3, wherein said screws are substantially equally circumferentially spaced apart.

5. The spinnerette assembly of claim 4, wherein said mounting block includes threaded bores, and wherein said spinnerette plate includes apertures each in registry with a respective one of said threaded bores, and wherein each of said screws is positioned in a respective one of said apertures and threadably coupled to said threaded bore.

6. The spinnerette assembly of claim 1, wherein said orifice plate has a thickness dimension of between about 0.01 inch to about 0.25 inch.

7. The spinnerette assembly of claim 1, wherein said orifice plate has a thickness dimension of between about 0.03 inch to about 0.25 inch.

8. The spinnerette assembly of claim 1, wherein said orifice plate has a thickness dimension of about 0.05 inch.

9. A spinnerette assembly for forming synthetic fibers comprising:

a mounting block having a planar mounting face and a plurality of supply bores each having a discharge opening at said mounting face; and a planar orifice plate having a thickness of less than about 0.25 inch in contact with said mounting face of said mounting block, said orifice plate having a plurality of capillary openings each in fluid communication with the discharge opening of a respective one of said supply bores; and a number of screw attachments substantially uniformly circumferentially surrounding each said capillary opening of said orifice plate and the discharge opening of each said respective one of said supply bores, said screws being threadably coupled to said mounting block through said orifice plate to compressively rigidly fix said orifice plate to said mounting face of said mounting block and thereby impart a symmetrical circumferential compressive sealing force surrounding each of said capillary and discharge openings, whereby said capillary and discharge openings are sealed against fluid leakage.

10. The spinnerette assembly of claim 9, wherein said mounting block includes threaded bores, and wherein said spinnerette plate includes apertures each in registry with a respective one of said threaded bores, and wherein each of said screws is positioned in a respective one of said apertures and threadably coupled to said threaded bore.

11. The spinnerette assembly of claim 9, wherein said orifice plate has a thickness dimension of between about 0.01 inch to about 0.25 inch.

12. The spinnerette assembly of claim 9, wherein said orifice plate has a thickness dimension of between about 0.03 inch to about 0.25 inch.

13. The spinnerette assembly of claim 9, wherein said orifice plate has a thickness dimension of about 0.05 inch.

* * * * *